US006497813B2

(12) United States Patent
Ackerson et al.

(10) Patent No.: US 6,497,813 B2
(45) Date of Patent: Dec. 24, 2002

(54) SOLVENT EXTRACTION REFINING OF PETROLEUM PRODUCTS

(75) Inventors: Michael D. Ackerson, Fayetteville, AR (US); Michael Steven Byars, Fayetteville, AR (US)

(73) Assignee: Process Dynamics, Inc., Fayetteville, AR (US)

( * ) Notice: Subject to any disclaimer, the term of this patent is extended or adjusted under 35 U.S.C. 154(b) by 0 days.

(21) Appl. No.: 09/765,797

(22) Filed: Jan. 19, 2001

(65) Prior Publication Data

US 2002/0096451 A1 Jul. 25, 2002

(51) Int. Cl.[7] ..... C10G 73/38; C10G 73/02; C10G 73/06; C10G 17/04

(52) U.S. Cl. ..... 208/311; 208/27; 208/28; 208/31; 208/33; 208/35; 208/37; 208/38

(58) Field of Search ..... 208/311, 27, 28, 208/31, 33, 35, 37, 38

(56) References Cited

U.S. PATENT DOCUMENTS

| | | | | |
|---|---|---|---|---|
| 4,081,352 A | | 3/1978 | West et al. | |
| 4,273,645 A | | 6/1981 | Audeh et al. | |
| 4,328,092 A | | 5/1982 | Sequeira, Jr. | |
| 4,381,234 A | | 4/1983 | Audeh et al. | |
| 4,909,927 A | | 3/1990 | Bell | |
| 4,911,821 A | | 3/1990 | Katzer et al. | |
| 5,006,222 A | * | 4/1991 | Sequeira | 208/33 |
| 5,171,426 A | | 12/1992 | Mead et al. | |
| 5,234,597 A | | 8/1993 | Welmers et al. | |
| 5,616,238 A | | 4/1997 | Boyle et al. | |

* cited by examiner

*Primary Examiner*—Walter D. Griffin
*Assistant Examiner*—Tam M. Nguyen
(74) *Attorney, Agent, or Firm*—Grady K. Bergen

(57) ABSTRACT

A method of refining a petroleum product to remove aromatics and to separate paraffinic oils and waxes is provided. The method involves the utilization of phase equilibria wherein crystallized or solidified waxes, normally present in the petroleum product, are used to remove oils from a liquid solvent phase containing dissolved aromatics present in the unrefined petroleum product. The wax containing the oils is separated from the aromatic-containing solvent and is further processed to separate the waxes and oils. For petroleum products containing little, if any, wax, additional wax may be added and recycled back for further use in removing oils from the petroleum product. The method has particular application in preparing lubricating oils having a high viscosity index, where the presence of aromatics and wax can be detrimental.

24 Claims, 1 Drawing Sheet

SOLVENT EXTRACTION REFINING OF PETROLEUM PRODUCTS

TECHNICAL FIELD

This invention relates to a method of refining petroleum products, and in particular, to a method of refining petroleum products by the use of solvent extraction.

BACKGROUND

Solvent extraction used in petroleum refining is typically used in refining or upgrading various petroleum distillates and deasphalted oil. The presence of aromatic fractions is often undesirable, because such compounds often tend to oxidate or thermally degrade. With respect to diesel and other fuels, government regulations may limit the presence of aromatics. Aromatics also have poor viscometric properties, which is particularly important with respect to the production of lubricating or lube oils. For lube oils, the property of the lube oils that are most often used to indicate lube quality with regard to aromatics is the viscosity index (VI). Oils with high VI (95 or greater) are generally considered acceptable. Oils with a VI below 95 are usually considered inferior. Extracting the aromatics from these oils increases the VI of the oil. As presented herein, viscosity indices are determined pursuant to ASTM D2270.

Typical solvent extraction processes used in the refining of petroleum products and distillates utilize highly polar solvents. These solvents may include such things as phenol, furfural and NMP (N-methyl-pyrolidone), with NMP being the most recently developed solvent system presently in use for removing aromatic compounds. These solvents are highly selective for aromatics and various polar-compounds, but are less selective for saturated hydrocarbons, such as paraffins and cycloparaffins. The aromatic products removed during extraction can be used in fuels production or in specialized applications requiring high aromaticity.

The prior art solvent extraction techniques are usually carried out in a continuous flow process in which the solvent and petroleum product feed stream are maintained in the liquid phase and in countercurrent contact. The solvent is typically recovered, with the aromatics being removed, and the solvent is recycled back into the solvent feed stream. The solvent extraction is usually carried out at elevated temperatures that are well above ambient. Typically, these temperatures are from about 100° F. to 250° F. The elevated temperatures facilitate the flow of the petroleum products, which may contain wax, as well as increase the solubility of the aromatics in the solvent. At these elevated temperatures, however, saturates (i.e. paraffins and cycloparaffins), which may be either oils and/or waxes, may also be extracted by the solvent, resulting in lower yields of these products.

Crude petroleum and partially refined petroleum commonly contain waxes (usually paraffin waxes). These waxes crystallize or solidify at cooler temperatures. This is particularly notable with higher molecular weight n-paraffins, certain branched or iso-paraffins, and cycloparaffins. When petroleum is being refined for use as a lubricating oil, the presence of these materials, which crystallize within the range of temperatures for which the lubricating oils are used, is very deleterious. Thus, these materials are commonly removed in the refining process, which is oftentimes referred to as "dewaxing." Therefore, after extraction, dewaxing of the petroleum products is usually carried out to improve the oil's low temperature properties.

While conventional solvent refining or extraction techniques may be adequate for many applications, improvements are needed. In particular, extraction techniques that require less energy and processing equipment, and that result in higher purity and greater yields is highly desirous.

SUMMARY

A method of refining a petroleum product is carried out by providing an unrefined petroleum product containing a first petroleum fraction and a second fraction to be separated, and wherein the first petroleum fraction has a melt point temperature. The unrefined petroleum product contains an amount of extractant, with the extractant having a freezing point temperature that is greater than the melt point of the first petroleum fraction.

The unrefined petroleum product is at a temperature at or above its pour point temperature so that the extractant is substantially liquefied. The first petroleum fraction is substantially dissolved within the liquefied extractant. A solvent is admixed with the unrefined petroleum product, with the second fraction being soluble within the solvent so that the second fraction is dissolved therein, and wherein the extractant is substantially insoluble within the solvent.

The mixture of unrefined petroleum product and solvent is brought to a temperature at or below the freezing point temperature of the extractant so that the extractant containing the dissolved first petroleum fraction is crystallized, while the solvent containing the dissolved second fraction remains in a liquid phase.

The crystallized extractant containing the dissolved first petroleum fraction is then separated from the liquid phase.

In another embodiment, a petroleum product is refined by providing an unrefined petroleum product containing a first petroleum fraction and a second fraction to be separated. The first petroleum fraction has a melt point temperature, and wherein the unrefined petroleum product contains an amount of extractant with a freezing point temperature that is greater than the melt point of the first petroleum fraction.

The unrefined petroleum product is at a temperature at or above its pour point temperature so that the extractant is substantially liquefied, with the first petroleum fraction being substantially dissolved within the liquefied extractant. A first solvent in which the second fraction is soluble is admixed with the unrefined petroleum product so that the second fraction is dissolved within the first solvent, with the extractant being substantially insoluble within the first solvent.

The mixture of unrefined petroleum product and first solvent is brought to a temperature at or below the freezing point temperature of the extractant so that the extractant containing the dissolved first petroleum fraction is crystallized, and the first solvent containing the dissolved second fraction is in a liquid phase. The crystallized extractant containing the dissolved first petroleum fraction is then separated from the liquid phase.

After this separation, a second solvent is admixed with the crystallized extractant and first petroleum fraction, with the first petroleum fraction being soluble within the second solvent. The first petroleum fraction is then separated from the crystallized extractant, and wherein the first petroleum fraction may be further separated from the second solvent.

In still another embodiment of the invention, a method of preparing lubricating oil from a petroleum product is provided. This is accomplished by providing a petroleum product containing a lubricating oil fraction and a second fraction to be separated from the lubricating oil. The lubricating oil fraction has a melt point temperature, and the petroleum product contains an amount of extractant, with the extractant having a freezing point temperature that is greater than the melt point of the lubricating oil fraction.

The petroleum product is at a temperature at or above its pour point temperature so that the extractant is substantially liquefied, with the lubricating oil fraction being substantially dissolved within the liquefied extractant. A first solvent in which the second fraction is soluble is then admixed with the petroleum product so that the second fraction is dissolved within the first solvent, with the extractant being substantially insoluble within the first solvent. The mixture of petroleum product and first solvent is brought to a temperature at or below the freezing point temperature of the extractant so that the extractant containing the dissolved lubricating oil fraction is crystallized and the first solvent containing the dissolved second fraction is in a liquid phase. The crystallized extractant containing the dissolved lubricating oil fraction is then separated from the liquid phase.

A second solvent is then admixed with the crystallized extractant and lubricating oil fraction, with the lubricating oil fraction being soluble within the second solvent so that the lubricating oil fraction is dissolved within the second solvent. The lubricating oil fraction and second solvent is then separated from the crystallized extractant. The lubricating oil fraction is then separated from the second solvent to provide a lubricating oil.

BRIEF DESCRIPTION OF THE DRAWING

The sole FIGURE is a schematic flow diagram showing a process for refining a petroleum product in accordance with the present invention.

DETAILED DESCRIPTION

Figure 1:
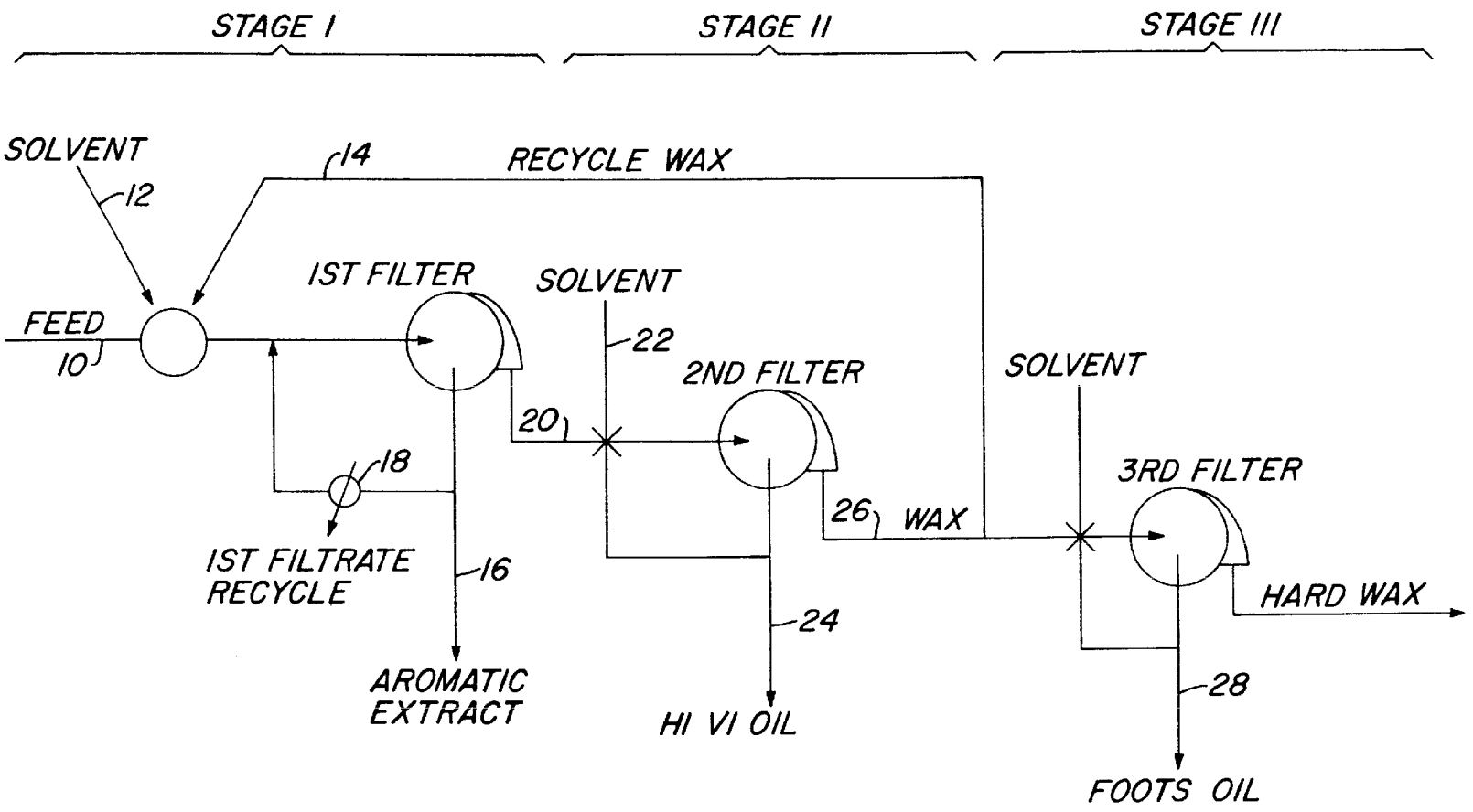

The present invention takes advantage of the thermodynamics and phase equilibria of an unrefined or partially refined petroleum product that is combined with a solvent for removing certain constituents from the unrefined petroleum product. In particular, the present invention utilizes waxes present in the unrefined petroleum product so that they serve as an extractant, with substantially all the hydrocarbon saturate oil being included in a crystallized or solid wax phase in a solvent dewaxing step so that the primary filtrate that is formed is a low pour, wax free, aromatic extract. This also eliminates the need for an additional solvent extraction units that would be necessary using conventional solvent extraction techniques. The oils can then be recovered in a second oil extraction step.

The present invention can be illustrated with reference to the sole FIGURE, which shows a schematic flow diagram of a continuous-flow solvent refining process carried out in accordance with the invention. It should be apparent to those skilled in the art, however, that there may be variations of this process. The process utilizes an unrefined product feed stream 10 to be processed. Non-limiting examples of those petroleum products making up the feedstock are the light and intermediate hydrocarbons and petroleum distillates and include such things as fuel oils, diesel oil, atmospheric gas oils, vacuum gas oils, lube distillates, etc. In the particular example shown in the FIGURE, high viscosity index lubricating oil is one of the products recovered.

The unrefined petroleum product is primarily composed of the n-paraffins, branched or iso-paraffins, cycloparaffins or mixtures thereof. The molecular weight of these materials may vary widely, and may include both oils and waxes. These materials are sometimes referred to as hydrocarbon saturates, due to their lack of carbon-carbon double or triple bonding. Waxes differ from the oils due to their higher melting and pour points. The oils and waxes typically are the saturated hydrocarbons from $C_{18}$ to $C_{60}$, usually having an average molecular weight of from about 250 g/mol to about 850 g/mol, although the oils and waxes may have average molecular weights of up to 1500 g/mol or higher. It should be apparent to those skilled in the art that the molecular structure and weight of those oils and waxes making up the petroleum product may vary, and the classification of these materials within a certain numerical range is primarily for the ease of description and to impart a better understanding of the invention. Furthermore, although classification has been made of these materials into oils and waxes, such classification should not construed in a limiting sense, as such terms may be relative. Materials that would typically be classified as waxes may have similar properties to oils at certain temperatures and pressures, while other fractions would remain in a solid or crystalline state at these same temperatures and pressures so that they retain their characteristics as waxes. The classification of such materials as oils or waxes may be dependent upon differences in melting or freezing point temperatures or other properties or characteristics. As used herein, the terms "melt point," "melting point" or "freezing point" may be used interchangeably and refer to the temperature where a material is in equilibrium between liquid and solid or crystalline phases under given pressure conditions.

In addition to the oil and wax saturates within the petroleum product, aromatics are present within the feed stream. As discussed previously, particularly with respect to lubricating oils, these materials can be detrimental to the oils and waxes, making their removal essential. In petroleum distillates, the aromatics content can range from about 10% to about 60% by volume. Polar compounds, such as those containing heteroatoms of oxygen or nitrogen, may also be present in the unrefined petroleum product. Additionally, unsaturated hydrocarbons, such as olefins and acetylene hydrocarbons may be present. The higher reactivity of these compounds makes their presence in the oil and wax saturates oftentimes undesirable, necessitating their removal.

Referring to the FIGURE, the petroleum feed stream 10 is kept at a temperature at or above its pour point temperature, and preferably at or above, preferably above, its cloud point temperature, to ensure that all the petroleum fractions are maintained in a liquefied state. As used herein, "pour point" generally refers to the temperature at which the material flows under given conditions. As used herein, "cloud point" refers to the temperature at which wax crystals first begin to form under given conditions. The pour point and cloud point temperatures of the feed stream will usually be the same or close to the pour point and cloud point temperatures, respectively, of the wax saturate fraction contained within the petroleum feed. Of course, these temperatures may also be quite different for the feed stream and wax saturate fraction, depending upon the feed stream makeup. Unless otherwise stated, temperatures given are generally for those processes carried out at atmospheric pressure. It should be readily apparent to those skilled in the art, that these temperatures may vary depending upon system conditions, however.

The temperature of the liquid feed stream will typically be anywhere from about 40° F. to about 250° F., but may vary depending upon the feed stream makeup. For most petroleum distillates processed in accordance with the invention, a suitable temperature range is from about 60° F. to about 180° F., with about 80° F. to about 140° F. being preferred. The operating pressure may vary depending upon the product stream being processed. Atmospheric pressure is suitable in most applications where the petroleum compounds can be maintained in their liquid state.

For removal of aromatic fractions in Stage I, as shown in the FIGURE, the feed stream 10 is mixed with a solvent 12. Mixing may be carried out in any type of suitable mixing equipment, such as a stir tank, however, co-current static mixing has been found to be suitable, if not preferable, in most applications.

Solvents used in the present invention for removing the aromatic fractions of the unrefined petroleum product may be a single solvent or a solvent system comprised as a mixture of a primary solvent and co-solvent. As used herein, the terms "solvent" or "solvents," unless otherwise specified, shall refer to such solvents used alone or as a solvent system comprised of a mixture of primary solvent and co-solvent, as is discussed more fully below. The solvent used in Stage I has the characteristic of having almost complete miscibility or total solubility for aromatics and polar compounds contained within the petroleum feed, while having limited miscibility or insolubility for the waxes contained within the petroleum feed stock.

For solvent systems, the primary solvent should be miscible with all the petroleum fractions making up the petroleum feed. Additionally, the primary solvent must be miscible with the co-solvent, discussed below. The primary solvent must be capable of readily dissolving the aromatic compounds. Preferably, the primary solvent has an affinity for and is capable of dissolving those compounds containing heteroatoms, such as nitrogen and oxygen, and unsaturated hydrocarbons. Examples of suitable primary solvents include toluene, xylene, benzene, methyl tert-amyl ether (TAME), methyl tert-butyl ether (MTBE), ethyl tert-butyl ether (ETBE), methylethyl ketone (MEK), methyl isobutyl ketone (MIBK), or similar aromatic compounds, ethers, ketones, or low molecular weight saturated hydrocarbons having molecular weights that are lower than that of the gas oil being refined, and preferably those having from four to ten carbon atoms.

The primary solvent is used in conjunction with a co-solvent. The co-solvent has the characteristic of having generally complete miscibility with the aromatic and polar compounds, but limited miscibility with all the remaining petroleum feed fractions, which generally include the oil and wax hydrocarbon saturates. Additionally, the co-solvent has complete miscibility with the solvent. The co-solvent is usually a ketone, alcohol or organic acid having a molecular weight composition with a low number of carbon atoms, preferably 7 or less, and having one or more oxygen atoms plus an even number of hydrogen atoms. Examples of such co-solvents include methanol, ethanol, n-propanol, isopropanol, MEK and acetone.

Examples of suitable primary solvent and co-solvent mixtures include MEK/toluene and acetone/toluene solvents. Typical solvent ratios for use in the Stage I separation for MEK/toluene are from about 100/0 to about 70/30 by volume. For acetone/toluene solvents, typical ratios are from about 95/5 to about 50/50 by volume.

As will be apparent to those skilled in the art, the solvent selected may vary depending upon the makeup of the unrefined petroleum feed stream. Depending upon the particular application, the concentration of primary solvent and co-solvent may also be varied. Increasing the concentration of co-solvent will typically facilitate higher yields of the hydrocarbon saturates, while increasing the primary solvent concentration typically results in lower yields of hydrocarbon saturates, but with a higher purity or lower aromatics content.

The solvent, in the form of a single solvent or solvent system, for Stage I, as described herein, is typically used in a ratio to the petroleum feedstock of from about 1:1 to 6:1. The solvent can also function as a coolant for lowering the temperature of the petroleum feedstock, as is discussed more fully below. Typical solvent temperatures range from about −40° F. to about 20° F., and should be well below the freezing point of the wax fraction to be separated if the solvent is being used as a coolant.

As shown in the FIGURE, wax may also be combined with the petroleum feed stream 10 through a recycle wax stream 14 or other wax source. Although many unrefined petroleum products will have a high enough wax content such that the addition of wax will be unnecessary, vacuum gas oils, for example, have a low enough wax content that additional wax must be added to ensure that all the saturate oils of the vacuum gas are dissolved and subsequently contained within the solidified wax phase. The wax could be added at a temperature above its pour point or otherwise added and heated so that it is liquefied during mixing with the petroleum feed stream. It is also possible to recycle the wax in its crystalline state, avoiding the expense of energy necessary to melt and recrystalize the wax.

After the petroleum feed stock, solvent and any necessary wax, have been combined and mixed together, the mixture is allowed to cool at or below, preferably below, the freezing point of the wax fraction, but above the freezing point of the oils, so that substantially all the hydrocarbon saturate oils are contained within the solidified or crystallized wax. The saturate oils, which have a melting point below that of the wax saturates, are contained within the solid phase having previously been dissolved within the wax, and having a greater affinity for the wax fraction than the solvent. Thus, the wax acts as an extractant to remove the saturate oils of the petroleum feed from the aromatics, which remain in the solvent liquid phase. While it is preferable to utilize cooled solvent to act as a heat exchange fluid and provide any necessary cooling, a heat exchanger can also be provided to remove heat if the solvent feed is not adequate to completely cool and solidify the wax fraction. Typical temperatures for carrying out the extraction step are from about −20° F. to about 75° F., with from about −10° F. to about 30 ° F. being preferred.

The cooled liquid/solid mixture is filtered or otherwise processed to separate the solid or crystallized wax containing the saturate oils and liquid solvent phase containing the dissolved aromatics. Cyclone filtration, or other suitable filtration or separation means that are well known to those skilled in the art for separating liquids and solids, can be used for this step. The filtrate 16 of aromatic extract and solvent is then removed for further processing, storage or use. A portion of the solid-free filtrate can also be recycled and combined with the petroleum feed stock prior to filtering to adjust the amount of solids present for optimal filter performance. Optionally, the filtrate can be cooled by means of a heat exchanger unit 18 for optimal cooling.

After filtration, the oil and wax are separated in a second stage, Stage II, in an oil-dewaxing step. Here, the filtered wax/oil precipitate 20 is combined with a solvent. In Stage II, the solvent is selected to have complete miscibility and greater affinity for the hydrocarbon saturate oils than the crystallized waxes. The solvents may also be the same as those solvent mixtures used in the aromatics extraction, however, the composition will be different, containing higher amounts of the primary solvents. A typical MEK/toluene solvent mixture ratio is from about 30/70 to about 70/30 by volume. For acetone/toluene solvent mixtures, a typical acetone/toluene ratio is from about 30/70 to about 70/30 by volume, with from about 30/70 to about 50/50 by volume being preferred. The solvent feed is usually used in an amount to provide a ratio of solvent to oil and wax feed of from about 0.5:1 to about 6:1, with from about 1:1 to about 1.5:1 being preferred.

During the oil-dewaxing step, the filtered wax/oil precipitate is maintained at a temperature at or below, preferably below, the freezing point of the wax fraction so that the wax hydrocarbon saturates remain crystallized. Typical solvent temperatures may generally be the same as those in the aromatics solvent extraction of Stage I. Temperatures will generally range from about −20° F. to about 75° F., with from about −10° F. to about 30° F. being preferred.

Because the solvent used during this stage has a greater affinity for the oils, the oils remain dissolved within the solvent, while the wax can be removed as an oil-free wax. The solidified wax is then separated by suitable filtration or centrifugation, which is well within the knowledge of those skilled in the art. As shown in the FIGURE, as an example, high viscosity oil 24 is recovered in the solvent liquid phase. The recovered oil can be separated from the solvent by conventional flash solvent recovery techniques, or other means well within the knowledge of those skilled in the art. A portion of the oil and solvent stream also can be recycled and combined with the oil and wax feed stream to adjust the amounts of solids for efficient filtration.

Oils that are 100% hydrocarbon saturates, as measured according to ASTM D-2007, can be readily obtained when using the above-described process. For lube oils, lube oils having a VI of from about 80 to about 110 can be readily obtained using the methods described.

A portion of the filtered wax 26 can be recycled as the recycle wax stream 14 used during the aromatics extraction, as previously discussed. Although the wax stream may be recycled in its solid state, it may optionally be melted and stripped of any solvents prior to its introduction with the unrefined petroleum feed stream 10. It is preferable to recycle the wax in its solid state, however, due to the additional need for energy necessary to melt the crystallized wax.

Although the above-described process results in the recovery of wax-free oils substantially free of any aromatics, it may be desirable to further process the recovered waxes to separate softer wax saturate fractions from the harder wax saturate fractions. This can be accomplished in a third recovery stage, Stage III, as shown in the FIGURE. The process is similar to that of Stage II, utilizing similar solvents, but is carried out at higher temperatures. Typical temperatures for this stage are from about 40° F. to 100° F. Again, the wax feed stream is combined with warm solvent and brought to a temperature at or above the pour point, and preferably at or above, preferably above, the cloud point temperature of the soft waxes, so that the soft waxes within the feed stream are completely liquefied and solubilized. The solvent is usually used in amounts to provide a solvent-to-wax feed ratio of from about 0.5:1 to about 6:1, with from about 1:1 to about 1.5:1 being preferred.

The mixture is maintained at or below, preferably below, the freezing point of the hard wax fractions but above the freezing point of the soft waxes so that the hard waxes remain crystallized, while leaving the softer waxes within the liquid phase solvent. The liquid and solid phases are then separated by suitable filtration means. A portion of the solvent and soft wax stream 28 can be recycled to the wax feed stream 26 to facilitate filtration and product separation.

In the particular example shown in the FIGURE, foots oil is recovered in the stream 28. The recovered soft wax 28 and hard wax 30 products, also substantially free of any aromatics, are collected for further handling or processing. If necessary, the process steps of the individual stages discussed above may be repeated to obtain higher purity or to ensure thorough removal of the different fractions of the petroleum feed stock. Waxes having an oil content of less than 0.5% by weight can be readily obtained by the methods discussed.

The following examples further illustrate the present invention.

EXAMPLE 1

A heavy vacuum gas oil (HVGO) was used as the unrefined petroleum feed stock to produce a high VI lube oil having a VI of 110 in a continuous flow process. The petroleum feed had a wax content of 10% by volume. An 80/20 by volume acetone/toluene solvent was used for the aromatic extraction step, with the solvent being used in a ratio of 300 parts to 100 parts petroleum feed stock. The filter temperature during the aromatic extraction was kept at approximately −5° F. Recycle wax from the dewaxing step was used in the amount of 30 parts to 100 parts petroleum feed stock.

In the dewaxing step, a 30/70 by volume acetone/toluene solvent was used in the amount of 200 parts to 100 parts oil and wax feed. The filter temperature during dewaxing was kept at approximately 5° F. The following yields were obtained:

Aromatic Extract—40 parts at VI=20;
Paraffinic Oil—50 parts at VI=110; and
Slack Wax—10 parts.

EXAMPLE 2

A HVGO was used as the unrefined petroleum feed stock to produce a high VI lube oil having a VI of 90 in a continuous flow process. The petroleum feed had a wax content of 50% by volume. An 80/20 by volume acetone/toluene solvent was used for the aromatic extraction step, with the solvent being used in a ratio of 400 parts to 100 parts petroleum feed stock. The filter temperature during the aromatic extraction was kept at approximately −5° F. Recycle wax from the dewaxing step was used in the amount of 20 parts to 100 parts petroleum feed stock.

In the dewaxing step, a 30/70 by volume acetone/toluene solvent was used in the amount of 200 parts to 100 parts oil and wax feed. The filter temperature during dewaxing was kept at approximately 5° F. The following yields were obtained:

Aromatic Extract—20 parts at VI=−20;
Paraffinic Oil—30 parts at VI=90; and
Slack Wax—50 parts.

The slack wax from the oil-dewaxing step was further processed to remove heavier oils. The slack wax feed consisted 50 parts slack wax, 35 parts toluene and 25 parts acetone. This was combined with a 70/30 by volume acetone/toluene solvent in an amount of 200 parts to 100 parts wax feed. The filter temperature was maintained at approximately 70° F. to yield 10 parts foots oil and 40 parts hard wax.

EXAMPLE 3

Atmospheric gas oil (AGO) was used as the unrefined petroleum product feed stock. To 100 parts feed, 10 parts toluene, 30 parts slack wax and 130 parts acetone were added. The extraction filter temperature was −10° F. with a 35% volume yield on extract. For the dewaxing step, 100 parts of toluene was added to the wax cake (remaining solvent still present), and the slurry was filtered at −10° F. The properties of the dewaxed oil were 50% volume yield of oil, with a viscosity at 100° F. of 40 SUS and a VI of 98. Typical furfural solvent extraction on this material provides a 43% volume yield with a viscosity at 100° F. of 39 SUS and a VI of 94.

EXAMPLE 4

Light vacuum gas oil (LVGO) was used as the product feed. To 100 parts feed, 40 parts toluene, 30 parts slack wax and 200 parts acetone were added. The extraction filter temperature was −1° F., with a 40% volume yield of aromatics on extract. For the dewaxing step, 100 parts of toluene was added to the wax cake (remaining solvent still present), and the slurry was filtered at −10° F. The properties of the dewaxed oil were 45% volume yield of oil with a viscosity at 100° F. of 92 SUS and a VI of 98. Typical furfural solvent extraction on this material provides a 38% volume yield with a viscosity at 100° F. of 91 SUS and a VI of 92.

EXAMPLE 5

Medium vacuum gas oil (MVGO) was used as the product feed. To 100 parts feed, 40 parts toluene, 25 parts slack wax and 220 parts acetone were added. The extraction filter temperature was −2° F., with a 29% volume yield of aromatics on extract. For the dewaxing step, 150 parts of toluene was added to the wax cake (remaining solvent still present), and the slurry was filtered at 1° F. The properties of the dewaxed oil were 56% volume yield of oil, with a viscosity at 100° F. of 220 SUS and a VI of 93. Typical furfural solvent extraction on this material provides a 49% volume yield with a viscosity at 100° F. of 203 SUS and a VI of 92.

EXAMPLE 6

Heavy vacuum gas oil (HVGO) was used as the product feed. To 100 parts feed, 80 parts toluene, 30 parts slack wax and 250 parts acetone were added. The extraction filter temperature was 0° F., with a 30% volume aromatic yield on extract. For the dewaxing step, 120 parts of toluene was added to the wax cake (remaining solvent still present), and the slurry was filtered at −5° F. The properties of the dewaxed oil were 55% volume yield of oil, with a viscosity at 100° F. of 426 SUS and a VI of 91. Typical furfural solvent extraction on this material provides a 43% volume yield with a viscosity at 100° F. of 351 SUS and a VI of 94.

EXAMPLE 7

Deasphalted oil (DAO) was used as the product feed. To 100 parts feed, 80 parts toluene, 50 parts slack wax and 100 parts acetone were added. The extraction filter temperature was 10° F. with a 35% volume aromatics yield on extract. For the dewaxing step, 180 parts of toluene was added to the wax cake (remaining solvent still present), and the slurry was filtered at 0° F. The properties of the dewaxed oil were 50% volume yield, with a viscosity at 100° F. of 2550 SUS and a VI of 93. Typical furfural solvent extraction on this material provides a 41% volume yield with a viscosity at 100° F. of 2400 SUS and a VI of 92.

As can be seen, the present invention has several advantages over the prior art. The process has a lower energy requirement because it is carried out at lower temperatures than conventional solvent extraction techniques, which require elevated temperatures. Because lower temperatures are used, less oil and wax is removed with the solvent, resulting in higher yields of the oil and wax saturates. The invention eliminates the need for a separate solvent extraction unit or system, utilizing instead wax present within the petroleum feed in a dewaxing step to remove oils from the aromatics. Additionally, oils with a lower content of aromatics and waxes can be recovered utilizing the method of the invention, making the invention particularly useful in recovering lubricating oils from petroleum distillates.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of refining a petroleum product comprising:

providing an unrefined petroleum product containing a first petroleum fraction, which is a hydrocarbon saturate, and a second fraction to be separated, which includes aromatic hydrocarbons, polar compounds, or unsaturated hydrocarbons, the first petroleum fraction having a melt point temperature, and wherein the unrefined petroleum product contains an amount of extractant, which is a hydrocarbon saturate, the extractant having a freezing point temperature that is greater than the melt point temperature of the first petroleum fraction, the unrefined petroleum product being at or above the pour point temperature of the unrefined petroleum product so that the extractant is in a substantially liquefied state with the first petroleum fraction being substantially dissolved within the extractant;

admixing with the unrefined petroleum product a solvent in which the second fraction is soluble so that the second fraction is dissolved within the solvent, and wherein the extractant is substantially insoluble within the solvent;

bringing the mixture of unrefined petroleum product and solvent to a temperature below the freezing point temperature of the extractant so that the extractant containing the dissolved first petroleum fraction is crystallized and the solvent containing the dissolved second fraction is in a liquid phase; and separating the crystallized extractant containing the dissolved first petroleum fraction from the liquid phase.

2. The method of claim 1, wherein:

the first petroleum fraction is a hydrocarbon saturate.

3. The method of claim 1, wherein:

the second fraction includes aromatic hydrocarbons.

4. The method of claim 1, wherein:

the second fraction includes polar compounds.

5. The method of claim 1, wherein:

the mixture of unrefined petroleum product and solvent are brought to a temperature of from about −20° F. to about 75° F. upon admixing of the solvent.

6. The method of claim 1, wherein:

the extractant constitutes a fraction of the unrefined petroleum product.

7. The method of claim 1, wherein:

the first petroleum fraction and the extractant include those hydrocarbon saturates having an average molecular weight ranging from about 250 g/mol to about 1500 g/mol.

8. A method of refining a petroleum product comprising:

providing an unrefined petroleum product containing a first petroleum fraction which is a hydrocarbon saturate and a second fraction, which includes aromatic hydrocarbons, polar compounds, or unsaturated hydrocarbons, to be separated, the first petroleum fraction having a melt point temperature, and wherein the unrefined petroleum product contains an amount of extractant, which is a hydrocarbon saturate, the extractant having a freezing point temperature that is greater than the melt point temperature of the first petroleum fraction, the unrefined petroleum product being at a temperature at or above the pour point temperature of the unrefined petroleum product so that the extractant is in a substantially liquefied state, with the first petroleum fraction being substantially dissolved within the liquefied extractant;

admixing with the unrefined petroleum product a first solvent in which the second fraction is soluble so that the second fraction is dissolved within the first solvent, and wherein the extractant is substantially insoluble within the first solvent;

bringing the mixture of unrefined petroleum product and first solvent to a temperature below the freezing point temperature of the extractant so that the extractant containing the dissolved first petroleum fraction is crystallized and the first solvent containing the dissolved second fraction is in a liquid phase;

separating the crystallized extractant containing the dissolved first petroleum fraction from the liquid phase;

admixing a second solvent to the separated crystallized extractant and first petroleum fraction, with the first petroleum fraction being soluble within the second solvent so that the first petroleum fraction is dissolved within the second solvent; and separating the first petroleum fraction from the crystallized extractant.

9. The method of claim 8, further comprising:

separating the first petroleum fraction from the second solvent.

10. The method of claim 8, wherein:

the first petroleum fraction is a hydrocarbon saturate.

11. The method of claim 8, wherein:

the second fraction includes aromatic hydrocarbons.

12. The method of claim 8, wherein:

the second fraction includes polar compounds.

13. The method of claim 8, wherein:

the mixture of unrefined petroleum product and first solvent are brought to a temperature of from about −20° F. to about 75° F. upon admixing of the first solvent.

14. The method of claim 8, wherein:

the extractant constitutes a fraction of the unrefined petroleum product.

15. The method of claim 8, wherein:

the method of refining the petroleum product is a continuous flow process, and wherein at least a portion of the extractant is recycled after separating the first petroleum fraction by combining said portion with the unrefined petroleum product.

16. The method of claim 8, wherein:

the first petroleum fraction and the extractant include those hydrocarbon saturates having an average molecular weight ranging from about 250 g/mol to about 1500 g/mol.

17. The method of claim 9, wherein:

the separated first petroleum fraction is lubricating oil, and wherein the lubricating oil has a viscosity index of from about 90 or greater.

18. The method of claim 9, wherein:

the separated first petroleum fraction is lubricating oil, and wherein the lubricating oil has a viscosity index of from about 95 or greater.

19. The first petroleum fraction separated by the method of claim 8.

20. A method of preparing lubricating oil from a petroleum product comprising:

providing a petroleum product containing a lubricating oil fraction which is a hydrocarbon saturate and a second fraction, which includes aromatic hydrocarbons, polar compounds, or unsaturated hydrocarbons, to be separated from the lubricating oil fraction, the lubricating oil fraction having a melt point temperature, and wherein the petroleum product contains an amount of extractant, which is a hydrocarbon saturate, the extractant having a freezing point temperature that is greater than the melt point of the lubricating oil fraction, the petroleum product being at a temperature at or above the pour point temperature of the petroleum product so that the extractant is in a substantially liquefied state, with the lubricating oil fraction being substantially dissolved within the liquefied extractant;

admixing with the petroleum product a first solvent in which the second fraction is soluble so that the second fraction is dissolved within the first solvent, and wherein the extractant is substantially insoluble within the first solvent;

bringing the mixture of petroleum product and first solvent to a temperature at or below the freezing point temperature of the extractant so that the extractant containing the dissolved lubricating oil fraction is crystallized and the first solvent containing the dissolved second fraction is in a liquid phase;

separating the crystallized extractant containing the dissolved lubricating oil fraction from the liquid phase;

admixing a second solvent to the crystallized extractant and lubricating oil fraction, with the lubricating oil fraction being soluble within the second solvent so that the lubricating oil fraction is dissolved within the second solvent;

separating the lubricating oil fraction and second solvent from the crystallized extractant; and separating the lubricating oil fraction from the second solvent.

21. The method of claim 20, wherein:

the separated lubricating oil has a viscosity index of from about 90 or greater.

22. The method of claim 20, wherein:

the separated lubricating oil has a viscosity index of from about 100 or greater.

23. The method of claim 1, wherein:

the second fraction includes unsaturated hydrocarbons.

24. The method of claim 8, wherein:

the second fraction includes unsaturated hydrocarbons.

* * * * *